United States Patent [19]

Faulstich

[11] 4,162,736

[45] Jul. 31, 1979

[54] PLASTIC CAP AND CONTAINER CONSTRUCTION

[75] Inventor: George W. Faulstich, San Carlos, Calif.

[73] Assignee: Three Sisters Ranch Enterprises, San Carlos, Calif.

[21] Appl. No.: 852,189

[22] Filed: Nov. 16, 1977

[51] Int. Cl.[2] ..... B65D 41/48

[52] U.S. Cl. ..... 215/256; 215/31; 215/320; 215/321

[58] Field of Search ..... 215/256, 31, 320, 321

[56] References Cited

U.S. PATENT DOCUMENTS

| | | | |
|---|---|---|---|
| 3,019,933 | 2/1962 | Gould | 215/321 |
| 3,338,446 | 8/1967 | Faulstich | 215/256 X |
| 3,707,240 | 12/1972 | Wilson | 215/256 |
| 3,840,137 | 10/1974 | Faulstich | 215/256 |
| 3,940,004 | 2/1976 | Faulstich | 215/256 |
| 3,946,891 | 3/1976 | Picoy | 215/256 |
| 3,991,904 | 11/1976 | Davis | 215/256 X |

FOREIGN PATENT DOCUMENTS

| | | | |
|---|---|---|---|
| 338369 | 11/1959 | Switzerland | 215/256 |

*Primary Examiner*—Donald F. Norton
*Attorney, Agent, or Firm*—Julian Caplan

[57] ABSTRACT

A plastic container neck has an inside substantially vertical sealing surface, a top groove, a very smooth second sealing surface of less diameter than the first sealing surface, a lower groove and a vertical stretch. The outside of the neck has a vertical surface, a horizontal, inwardly-extending shoulder, an indented second vertical surface of lesser diameter than the first vertical surface and an external bead, and a third vertical surface. The container has a substantially uniform wall thickness. The second sealing surface has an "injection finish" obtained by use of a blow pin in the mold. The cap has lower internal beads interrupted in a plurality of gaps, permitting stretching of the cap to seat on the neck. Thickenings on the interior of the cap outer skirt paralleling the spiral groove of the skirt from the bottom edge of the skirt to the horizontal groove to facilitate tearing the skirt.

5 Claims, 4 Drawing Figures

PLASTIC CAP AND CONTAINER CONSTRUCTION

This invention relates to a new and improved plastic cap and thin-walled container construction.

With reference to the container construction, a thin-walled light-weight plastic container of a material such as polyethylene which is inexpensive to manufacture is disclosed. A feature of this container is the fact that it may be blow-molded but injection molding may be used. However, a pin is inserted in the inside of the neck to provide an extremely accurate dimension in a vertical sealing surface which is spaced downward from the top of the container neck. Further, as a result of the blow molding process, the external dimensions of the neck are quite accurate. Hence, a liquid-tight seal is possible with a cap of the construction hereinafter described wherein the seal is tight in the accurate sealing surface of the interior of the neck and also at the top or lip of the neck and at least one external surface of the neck. Further, accurately spaced shoulders are provided for gripping the cap in initial condition and also when the lower portion of the skirt is torn in accordance with the teaching of U.S. Pat. No. 3,338,446.

The accuracy in the surfaces heretofore mentioned has not heretofore been achieved with blow molded bottles without expensive finishing steps after molding. Hence, the cost of fabrication of the bottle as well as the cost of the materials (by reason of the thin-wall construction) is considerably reduced over conventional practice.

A bumper ring may be formed below the neck to permit loading the bottles into boxes or crates by grippers without contacting the cap. Hence, displacement of the cap during loading is avoided.

With respect to the cap, the lower bead, which is located immediately below the horizontal tear line of the cap, is interrupted. Interruption of the bead makes it possible for the skirt to stretch when the cap is being installed on the bottle neck in a conventional capping machine. Hence, the force required to seat the cap on the neck is lessened and this materially reduces the tendency of the neck of the bottle to be crushed or deformed during capping.

A further feature of the cap is the fact that there is internal thickening of the skirt on either side of the spiral score line which extends from the bottom edge of the skirt to the horizontal score line. These thickenings reduce any tendency for inaccurate tearing when the pull tab is pulled.

It will be seen that the structure of the cap and of the container neck cooperates to make possible the advantages of each; and more particularly, that the structure of the cap permits use with a thinner and more flexible container wall, yet permits the cap to be applied with conventional machinery or by hand.

Many of the advantages of U.S. Pat. No. 3,338,446, on which this invention is an improvement, are incorporated in the present structure. For sake of brevity, these advantages are not repeated, but reference is made to the aforementioned patent.

Other objects of the present invention will become apparent upon reading the following specification and referring to the accompanying drawings in which similar characters of reference represent corresponding parts in each of the several views.

Figure 4:
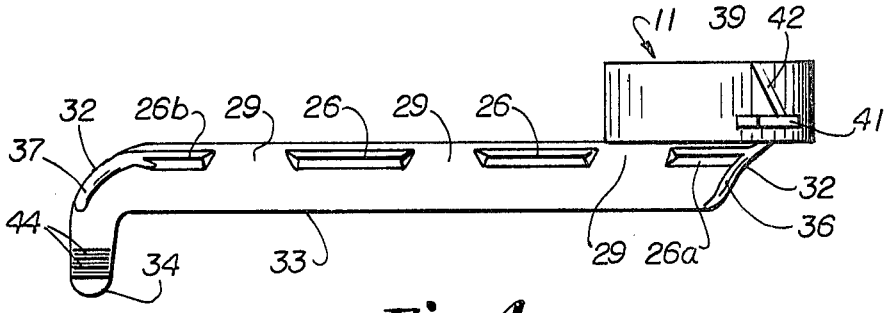
FIG. 4 is a side elevational view of a cap in accordance with the invention with the tear strip partially torn off to reveal internal construction of the cap skirt.

The present invention comprises improvements over U.S. Pat. No. 3,338,446 both in the cap 11 and container 12. For convenience, the cap will be first described.

Cap 11 comprises a top disc 16 having a planar undersurface. Depending from the underside of disc 16 is an interior skirt 17 which is relatively short and has a substantially vertical inner wall 18, a substantially vertical outer wall 19 and an inwardly-downwardly tapered edge 29 which merges with the lower edge of wall 18.

Outwardly spaced from the inner skirt 17 is outer skirt 21 which has a substantially vertical outer wall. Considering the inner wall of outer skirt 21, extending down from disc 16 is a substantially vertical top stretch 22 of a length about equal to that of inner skirt 17, which terminates in a rounded internal bead 23. Below bead 23 is an intermediate vertical wall 24 which terminates in an internal lower bead 26. Bead 26 has a slightly downward-inward slanted top surface 27 which merges with a substantially downwardly-outwardly inclined lower surface 28. As is best shown in FIG. 4, the lower bead 26 is not continuous (i.e., it is not circumferential) but is interrupted with a plurality of gaps 29. Hence, the wall thickness of the skirt 21 at the gaps 29 is considerably thinner than at the bead sections 26. This permits stretching of the skirt during capping, as has heretofore been explained. Spaced immediately above the top surface of bead 26 is a horizontal groove formed on the interior of skirt 21 to permit tearing. Extending upwardly in a slightly spiral configuration is spiral groove 32 which extends from the bottom edge 33 of the outer skirt 21 to merge with the horizontal score line 31. A tear tab 34 which may be easily gripped with the fingers depends from the lower edge of skirt 33 immediately to one side of spiral groove 32. To facilitate gripping tab 34, transverse ridges 44 may be formed thereon. To properly guide tearing of groove 32 when the tab 34 is pulled, there is a thickening 36 on one side of groove 32 and a thickening 37 on the other side. Thickening 36 merges with one of the interrupted bead section or stretch **26*a* (see FIG. 4) while the thickened section 37 merges with adjacent interrupted bead section or stretch 26*b*. It will be seen that in the assembled condition of the cap, prior to tearing along line 32, the sections 26*a* and 26*b* are separated only by a very narrow gap (as distinguished from gaps 29 between the other sections of the lower bead), the narrow gap being only sufficient for extension of spiral groove 32. It will also be noted that the upper surfaces 27 of bead sections 26 are spaced slightly downwardly from the horizontal groove 31**.

After the lower portion of the skirt is completely torn off (by completion of the operation illustrated as partially completed in FIG. 4), there is a reclosure cap 39 above what was formerly the groove 31 which may be used to recap the container, as is explained in U.S. Pat. No. 3,338,446. To facilitate removing the reclosure cap, a horizontal finger hold 41 extends horizontally outwardly from the reclosure cap and is preferably strengthened by a gusset 42. It will be seen, particularly with reference to FIG. 1, however, that the finger hold 41 performs an additional function of strengthening the wall of the reclosure cap since it is located immediately above the intersection of grooves 31 and 32. Hence, any tendency for the skirt to be torn improperly is overcome by the additional strength imparted to the skirt at said intersection.

Directing attention now to the neck of container 12, at the top is a horizontal inwardly turned flange 51 having a substantially flat top surface 52 dimensioned to fit against the underside of disc 16 between the inner skirt 17 and outer skirt 21. Describing, first, the interior surface of neck 12, proceeding downwardly from horizontal surface 52 at a substantially right angle thereto is a short first sealing surface 53. Because of practical problems in the molding process, the surface 53 is usually somewhat ragged and does not form a perfect seal with the inner skirt 17. Below surface 52 there is an outward groove 54 separating flange 52 from the second sealing surface 53 which is of lesser diameter than the surface 52. In the molding of the neck 12 a smooth pin is inserted which accurately forms smooth surface 56. This surface 56 seats against the lower edge of inner skirt surface 19 and forms a liquid tight seal. Below surface 56 is a second outward-extending groove 57 and below groove 57 is lower vertical surface 58 which is of lesser diameter than surface 56. Below surface 58, the interior wall 59 of the breast of the neck extends. In a preferred shape there is a bumper ring 72 which receives grippers of automatic loading equipment. Thus the grippers do not engage cap 11 and impair the seal.

It will be seen that the wall thicknesses of the neck 12 are substantially uniform throughout and are thinner than other plastic container necks of this general type.

Directing attention now to the exterior of neck 12, extending vertically downward from surface 52 is an external first vertical surface 61 which terminates at a sharp angle with horizontally-inwardly extending shoulder 62. The length of surface 61 is such that the bead 23 of the cap in assembled condition seats immediately under shoulder 62 and holds the cap in place, even when the score line has been torn. Thus the bead 23 and shoulder 62 keep the reclosure cap 39 in place. Below shoulder 62 is second vertical surface 63 which is of substantially lesser diameter than surface 61. Surface 63 terminates in external bead 64. Bead 64 has an outwardly-downwardly slanted upper surface 64 (at about 35° with the horizontal and approximately parallel to surface 28) which is rounded and merges with lower horizontal shoulder 67. Interrupted bead sections 26 seat immediately under shoulder 67. Below bead 64 there is a third vertical surface 68 which then merges with the external surface 69 of the breast.

Figure 2:
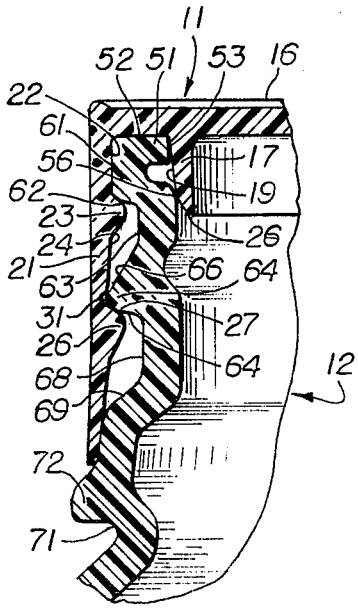
FIG. 2 is an enlarged vertical sectional view taken substantially along the line 2—2 of FIG. 1.
Figure 3:
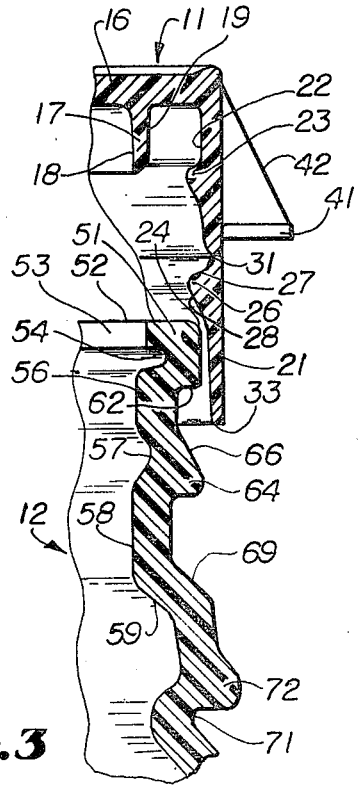
FIG. 3 is an exploded view of the structure of FIG. 2 showing the cap and container neck disassembled.

In the assembly of the cap 11 on the neck 12 (i.e., the downward movement of the cap 11 from the position of FIG. 3 to the seated position of FIG. 2), the skirt 21 stretches to permit the slanted surface 28 of lower bead 26 to slide over first the corner where the surfaces 52 and 61 intersect and then to slide over bead 64. Similarly, the rounded bead 23 slides over the same obstacles. In the seated position of FIG. 2, the bead 23 is seated under the shoulder 62 and the bead 26 is seated under the shoulder 67. There is a tight liquid seal between the external wall 19 of the inner skirt 17 and the surface 56, which has been stated to be extremely smooth. There is also a seating of the surface 53 against the wall 19 but, since the surface 53 is generally ragged, the seating at this area is poor. Surface 52 seats against the underside of disc 16 and surfaces 61 and 22 accurately seat together. Hence an extremely liquid-tight seal results.

Until the outer skirt 21 is torn, the cap 11 cannot be removed from the bottle neck 12 without deforming the neck 12. Hence tampering with the contents of the container is easily detected.

Figure 1:
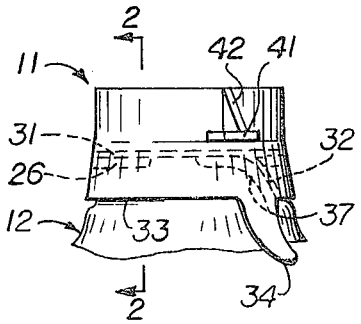
FIG. 1 is a fragmentary side elevational view of a cap in accordance with the present invention and a container neck.

When the user wishes to open the container, he first grips the tab 34 and pulls upwardly and to the left as view in FIG. 1, causing the skirt to tear along the spiral groove 32, being guided by the thickened portions 36 and 37. The user then pulls the tab 34 outwardly away from the neck 12 causing the skirt to tear along the groove 31 so that the entire tear strip below the groove 31 is removed. To open the bottle, the user than pries up on the finger hold 41 causing the bead 23 to snap outside of the shoulder 62. Reclosure is performed merely by pushing downward on the cap 11 until the bead 23 seats under the shoulder 62.

What is claimed is:

1. A cap having a central top disk, a thin-walled substantially cylindrical outer skirt of substantially uniform thickness depending from the periphery of said disk, said outer skirt being scored and weakened in a circumferential first line spaced downwardly from the top of said outer skirt and in a spiral second line joining said first line and extending down to the bottom edge of said outer skirt, a tab attached to the bottom edge of said outer skirt adjacent said second line, an upper internal circumferential bead on said outer skirt between said first line and said disk, a lower internal second bead on said outer skirt below but adjacent said first line, said second bead being interrupted in a series of gaps spaced around the circumference of said outer skirt, a thickening of said outer skirt immediately paralleling and on one side of said second line, a second thickening of said outer skirt immediately paralleling said second line and on the side of said second line opposite said first-mentioned thickening, an externally projecting finger hold on said outer skirt positioned immediately above the intersection of said first and second lines.

2. A cap according to claim 1 which further comprises a short inner skirt depending from said top disk spaced inward from said outer skirt.

3. In combination a cap according to claim 2 and a container formed of thin-walled, blow-molded plastic material having a cylindrical neck, said neck having an inturned top flange with a flat, horizontal lip, said flange terminating in an internal first substantially vertical sealing surface, a groove below said first sealing surface, an internal, smooth second vertical surface below said groove, said second surface being of lesser diameter than said first surface, a first external neck bead, a second external neck bead on the exterior of said neck vertically spaced from said first bead, each of said neck beads having a substantially horizontal shoulder on its lower edge, said inner skirt sealing against said first and second sealing surfaces, said lip sealing against the underside of said disk, said first and second beads of said cap seating under the horizontal shoulders of said first and second neck beads, respectively.

4. The combination of claim 3 in which said second bead has a first interruption about as wide as second line at said second line and said second bead extends in first and second stretches to either side of said first interruption and said stretches terminating in second and third interruptions remote from said first interruption.

5. A cap according to claim 1 in which said second bead has a first interruption about as wide as said second line at said second line and said second bead extending in first and second stretches to either side of said first interruption and said stretches terminate in second and third interruptions remote from said first interruption.

* * * * *